US006709290B2

(12) United States Patent
Yoshida

(10) Patent No.: US 6,709,290 B2
(45) Date of Patent: Mar. 23, 2004

(54) SHIELDING CONNECTOR

(75) Inventor: Norihito Yoshida, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/237,868

(22) Filed: Sep. 10, 2002

(65) Prior Publication Data

US 2003/0049956 A1 Mar. 13, 2003

(30) Foreign Application Priority Data

Sep. 11, 2001 (JP) ..... 2001-275515
Jul. 1, 2002 (JP) ..... 2002-192498

(51) Int. Cl.[7] ..... H01R 9/05; H01R 9/03
(52) U.S. Cl. ..... 439/585; 439/610
(58) Field of Search ..... 439/585, 610; 174/35 C

(56) References Cited

U.S. PATENT DOCUMENTS 5,145,409 A * 9/1992 Sato et al. ..... 439/585
6,210,223 B1 4/2001 Aoyama et al. ..... 439/585
6,384,335 B1 * 5/2002 Saito et al. ..... 174/74 R

FOREIGN PATENT DOCUMENTS

JP U 3-80982 8/1991

* cited by examiner

*Primary Examiner*—Hung V. Ngo
(74) *Attorney, Agent, or Firm*—Oliff & Berridge, PLC

(57) ABSTRACT

A shielding connector is disclosed having a construction such that after an inner conductor terminal is press connected to a signal conductor of a shielded cable, it is pushed into a dielectric member previously placed in an outer conductor terminal by utilizing a space as an opening of the upper surface of the outer conductor terminal. A small diameter member is provided which electrically reduces the opening diameter of the terminal insertion hole in the vicinity of an inner conductor terminal press connection part, whereby the connector impedance matching is achieved also at the press connection part.

6 Claims, 5 Drawing Sheets

SHIELDING CONNECTOR

BACKGROUND OF THE INVENTION

The present invention relates to a connection of such a cable as a wiring harness to electric devices or the like in a motor vehicle or the like. More particularly, the invention relates to a connection structure of a shielding connector for relay connecting a shielded cable to a printed circuit board in the electric device and an antenna.

An electric device in a motor vehicle, such as a car navigation system, contains a control-use printed circuit (PC) board on which electronic parts, IC (integrated circuit) packages and others are mounted. Recently, a transmission speed of an electric signal transmitted to and from the PC board is increased (viz., the transmission signal frequency is increased). Further, board patterns of the PC board are densely arranged. To transmit such high frequency signals, a shielded cable designed to be adapted for the high frequency signal transmission is generally used. With increase of the transmission signal frequency, also in the shielding connector for relay connecting the shielded cables, there is an increasing demand to take some measure for the high frequency signal transmission.

A called coaxial cable is known as an example of the shielded cable. Usually, the shielded cable has a coaxial structure having a signal conductor which is formed by binding a plurality of element wires and serves as a signal transmission line, a shielding conductor consisting of a plurality of braided element wires, an insulating member interposed between the signal conductor and the shielding conductor, and a sheath covering the outer periphery surface of the shielding conductor. The shielding conductor closely covers the outer periphery of the insulating member to thereby electrically shield the signal conductor.

Generally, the shielding connector for relay connecting coaxial cables for transmitting high frequency signals is formed with an internal conductor terminal to be connected to the signal conductor for transmitting a high frequency signal, an outer conductor terminal which is to be connected to the shielding conductor of the braid wire or the like and covers the internal conductor terminal for the electromagnetic shielding purpose, and a dielectric body of a predetermined dielectric constant provided between the internal conductor terminal and the outer conductor terminal. The shielding connector individually and electrically relay connects the signal conductor and the shielding conductor of a shielded cable to be relay connected, which are exposed by peeling the connection terminal and the insulating member off the shielded cable.

A typical example of such a shielding connector is disclosed in the Unexamined Japanese Patent Publication No. 2000-173725. FIG. 4A is a longitudinal sectional view showing the shielding connector, and FIG. 4B is a cross sectional view taken on line B—B in FIG. 4A. As shown, an insulating member and a sheath 71*c* of a coaxial cable 71 are peeled off to expose a signal conductor 71*a* and a shielding conductor 71*b*. A connection process of connecting the shielding connector to the coaxial cable follows. To start, a press connection part 72*a* of an inner conductor terminal 72 is press connected to the exposed signal conductor 71*a*. Then, the inner conductor terminal 72 is forcibly inserted into and fixed to a press-fitting bore 74*a* of a dielectric body 74, which has been put in and assembled to an outer conductor terminal 73. The shielding conductor 71*b* as is inverted on the coaxial cable 71 is put on a press connection part 73*a* of the outer conductor terminal 73, and compressed by the latter. Then, the sheath 71*c* and the shielding conductor 71*b* are both clamped with the press connection part 73*a* of the outer conductor terminal 73. Here, the connection work is completed.

In the step in which the inner conductor terminal 72 is forcibly inserted into and fixed to the dielectric body 74, which the step is executed before the step of clamping the shielding conductor with the press connection part 73*a* of the outer conductor terminal 73, a terminal insertion hole 73*b*, which is formed by opening the upper surface of the outer conductor terminal 73 to an upper part of the drawing, is utilized as a press-fitting work space, whereby the inner conductor terminal 72 may easily be press inserted into the connector by means of a press-fitting jig or another tool.

Another conventional art is disclosed in the Unexamined Japanese Utility Model Application Publication No. Hei 3-80982. FIG. 5A is a longitudinal sectional view showing the shielding connector and FIG. 5B is a cross sectional view taken on line C—C in FIG. 5A. As shown, an insulating member and a sheath 81*c* are peeled off a coaxial cable 81 to expose a signal conductor 81*a* and a shielding conductor 81*b*. In a step of connecting the shielding connector to those exposed parts, a dielectric body 84 and an inner conductor terminal 82 are assembled to an outer conductor terminal 83 in advance. The signal conductor 81*a* and the shielding conductor 81*b* are respectively put on a press connection part 82*a* of the inner conductor terminal 82 and a press connection terminal 83*a* of the outer conductor terminal 83 to which those conductors are to be connected. The former conductors and the latter terminals are press connected together simultaneously by using a press connection jig D or another appropriate jig. Then, the connection work is completed. For the press connection work of connecting the press connection part 82*a* of the inner conductor terminal 82, a press-inserting hole 83*b* is opened to an upper part and a lower part in the vicinity of the press connection part 82*a* of the outer conductor terminal 83. With the press-inserting hole, the press connection part, together with the coaxial cable 81, is press connected simultaneously to thereby providing easy connection.

Generally, the characteristic impedance of the transmission line for the high frequency signal transmission is set at 50 Ω, for example. The high frequency signal transmission line is impedance matched to the signal transmission paths of the PC board of the electric device to be relay connected or the cable also to be relay connected. If the transmission path contains a part where the characteristic impedance is not matched (impedance mismatching part), the signal reflects at the impedance mismatching part to reduce the transmission efficiency, and noise is generated thereat. Accordingly, the shielding connector as a relay connection part in the transmission path is also impedance matched to the signal transmission line.

The impedance of the shielding connector is matched to that of the shielded cable as the transmission line by adjusting a "ratio of the inside diameter of the body of the outer conductor terminal and the outside diameter of the terminal part of the inner conductor terminal" and "a dielectric constant of the dielectric body". As shown in FIGS. 4 and 5, the diameter of the press connection part 72*a* (82*a*) after the inner conductor terminal is press connected is designed to have a size and a shape, while giving priority to a reliability of its electrical connection to the signal conductor. Usually, it is smaller than the diameter of the terminal body. It does not satisfy the "ratio of the inside diameter of the body of the outer conductor terminal and the outside diameter of the terminal part of the inner conductor terminal". Further, a part of the wall of the outer conductor terminal near the press connection part is opened to secure a space for the work using the press-fitting jig or press-inserting jig. The press connection part as the connection part to the signal conductor of the inner conductor terminal is not covered in all directions with the outer conductor terminal provided for the electromagnetically shielding purpose and the dielectric body, and is exposed to air having a dielectric constant of $\epsilon r=1$. For this reason, the impedance of this part is not matched to that of the transmission line, and is higher than that of the shielded cable.

The transmitted electrical signal is reflected or radiated at the part where the impedance of the shielding connector is not equal to that of the shielded cable, and in this case, a normal transmission of the signal is impossible or noise is generated. Those disadvantageous phenomena are remarkable particularly in a frequency region of several GHz of the transmitted signal.

To cope with this, what a designer has to do is to lower the impedance at the press connection part of the inner conductor terminal so as to be matched to the impedance of other parts of the shielded cable and the shielding connector. Therefore, the impedance matching may be achieved by selecting the diameter of the press connection part of the inner conductor terminal after its press connection to be nearly equal to that of the body of the outer conductor terminal. A conventional method to increase the diameter of the press connection part is to wind a metal tape around the press connection part, and another method is to further press a cylindrical metal sleeve from its outside to increase its diameter.

The method of winding the metal tape has the following disadvantages. The manual work is essential to the work of winding the metal tape. In the case of the small connector, the metal tape must be wound on an extremely thin press connection part of a small inner conductor terminal. This work is extremely delicate, and it is almost impossible to impart a satisfactory working accuracy to such a press connection part. Further, if the tape turns aside, it will come in contact with the outer conductor terminal and cause a shortcircuiting problem. Additionally, it is very difficult to achieve an attempt to reduce the time taken for the step (terminal processing) of connecting of the connector and the cable to thereby reduce the cost to manufacture.

The method of further pressing a cylindrical metal sleeve from its outside to increase its diameter has the following advantages and disadvantages. This method enables the press connection process to be automated mechanically. In this case, the automated press connection is performed at the time of the cable terminal processing when the cable is connected to the connector. Accordingly, a sleeve pressing machine must be installed additionally every terminal processing line in an automated cable terminal processing factory. This results in increase of cost. Further, in some type of cable, the thickness of the signal conductor per se is varied, and a shape of the press connection part of the inner conductor terminal to be press connected to it is varied. Accordingly, the cross section size of the press connection part of the inner conductor terminal is also varied, and the outline of the sleeve to be pressed is varied. As a result, it is difficult to impedance match it to various types of cables.

SUMMARY OF THE INVENTION

Accordingly, an object of the present invention is to provided a shielding connector which ensures an impedance matching in the connector to thereby reduce the signal transmission loss by signal reflection and the like, and provides an easy terminal processing to the cable terminal.

According to the present invention, there is provided a shielding connector in which an inner conductor terminal to be connected to a signal conductor of a shielded cable is put in a cylindrical outer conductor terminal containing a dielectric body, and a shielding conductor of the shielded cable is connected to the outer conductor terminal, the shielded cable including the signal conductor, the shielding conductor, and an insulating member interposed between the signal conductor and the shielding conductor, and the shielded cable being covered with a sheath. In the shielding connector, a terminal insertion hole is formed in the outer conductor terminal in order to put the inner conductor terminal in the outer conductor terminal in connection with the dielectric body. The inner conductor terminal is put in the outer conductor terminal in a state that a connection part at which the inner conductor terminal is connected to the signal conductor is exposed within the terminal insertion hole. A conductive small diameter member which electrically reduces a diameter of the terminal insertion hole in the vicinity of the exposed connection part toward the connection part is provided in contact with the inner wall of the outer conductor terminal.

In the shielding connector thus constructed, the diameter of the connection part of the inner conductor terminal is increased in conformity with the outer conductor terminal. The diameter of the outer conductor terminal at that part is reduced in conformity with the connection part. The conductive small diameter member which electrically reduces a diameter of the terminal insertion hole in the vicinity of the exposed connection part toward the connection part is provided in contact with the inner wall of the outer conductor terminal.

With such a construction, the outer conductor terminal after its connection to the signal conductor of the shielded cable may be put in the dielectric body which is previously put in the outer conductor terminal by utilizing the terminal insertion hole formed opening a part of the wall surface of the outer conductor terminal, as in the conventional shielding connector. Further, the impedance in the vicinity of the press connection part at which the inner conductor terminal is connected to the signal conductor which, in the conventional technique, is high since the press connection part is exposed outside through the opening of the outer conductor terminal, is successfully reduced by electrically reducing the diameter of the opening of the outer conductor terminal at the corresponding part by using the small diameter member.

Accordingly, this part in the connector is impedance matched to another portion. In this respect, the impedance mismatching problem is solved. Accordingly, the signal reflection at and radiation from that part are reduced, and the resultant connector handles transmission signals of higher frequencies. Further, use of the small diameter member reduces the opening area of the terminal insertion hole. This feature reduces the radiation noise and incident noise quantities. In this respect, the resultant shielding connector has excellent characteristics.

For the terminal processing of connecting the connector to the terminal of the shielded cable, the small diameter member is merely provided in contact with the outer conductor terminal, while in the conventional connector needs the process of manually increasing the diameter of the press connection part by using the metal tape, or the process of pressing the metal sleeve. Therefore, the processing accuracy is good, and the terminal processing is easy.

When the small diameter member is installed to the dielectric body, the connector terminal processing cost is reduced. When the dielectric body and the small diameter member are one-piece molded, the connector terminal processing cost is reduced, and a number of required parts is reduced.

When the small diameter member is press fitted into aid outer conductor terminal, the connector is free from the impedance variation caused when the connector is vibrated by external force and the inner wall of the outer conductor terminal comes in contact with the small diameter member. Accordingly, good contact performance is ensured, and stable performances are then secured. When the small diameter member is resiliently put in the outer conductor terminal, there is no chance that the connector is vibrated by external force and the inner wall of the outer conductor terminal comes in contact with the small diameter member, and the impedance is varied.

DETAILED DESCRIPTION OF THE PREFERRED EMBODIMENTS

Figure 1:
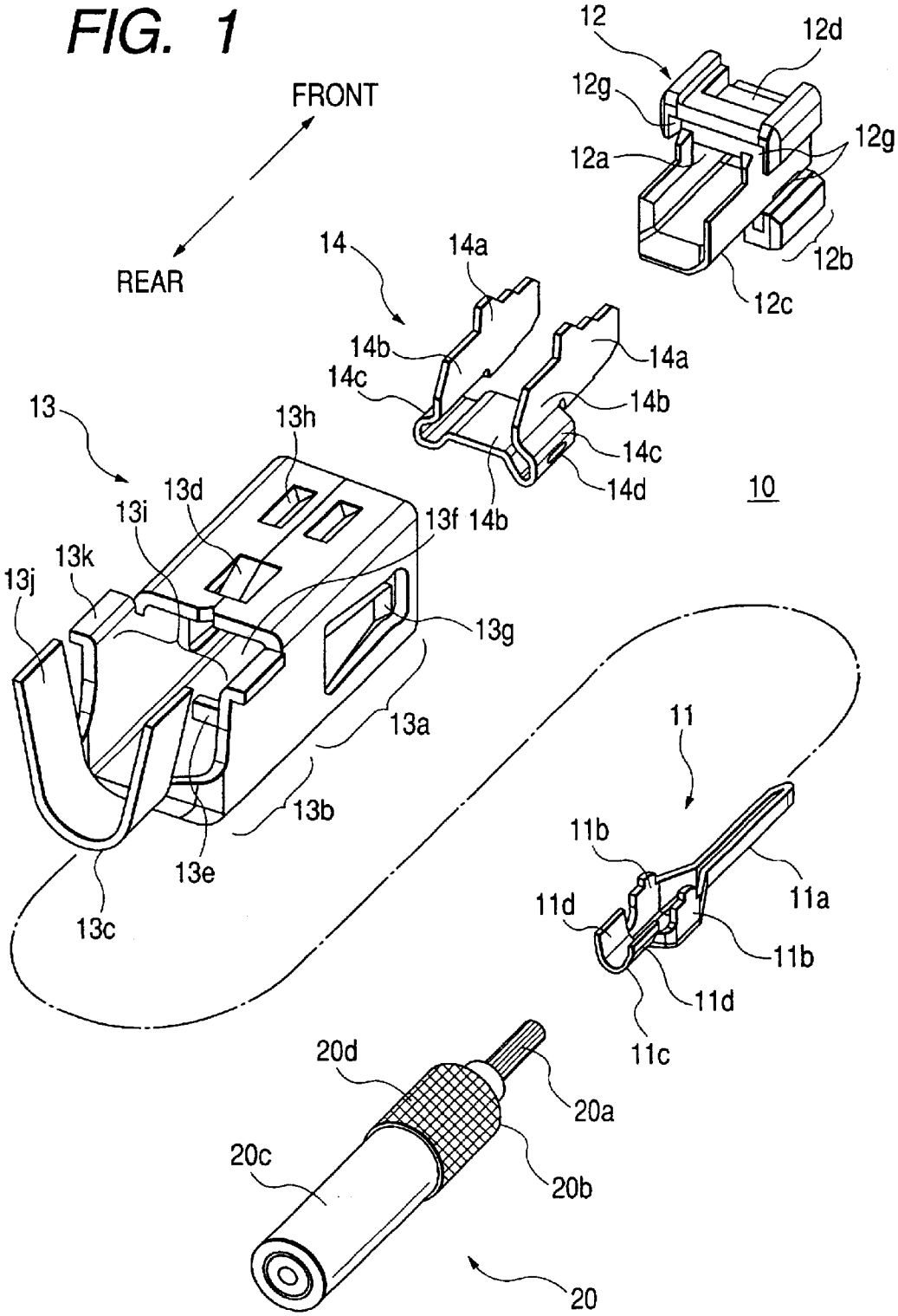
FIG. 1 is an exploded perspective view showing a shielding connector which is an embodiment of the present invention.
Figure 2:
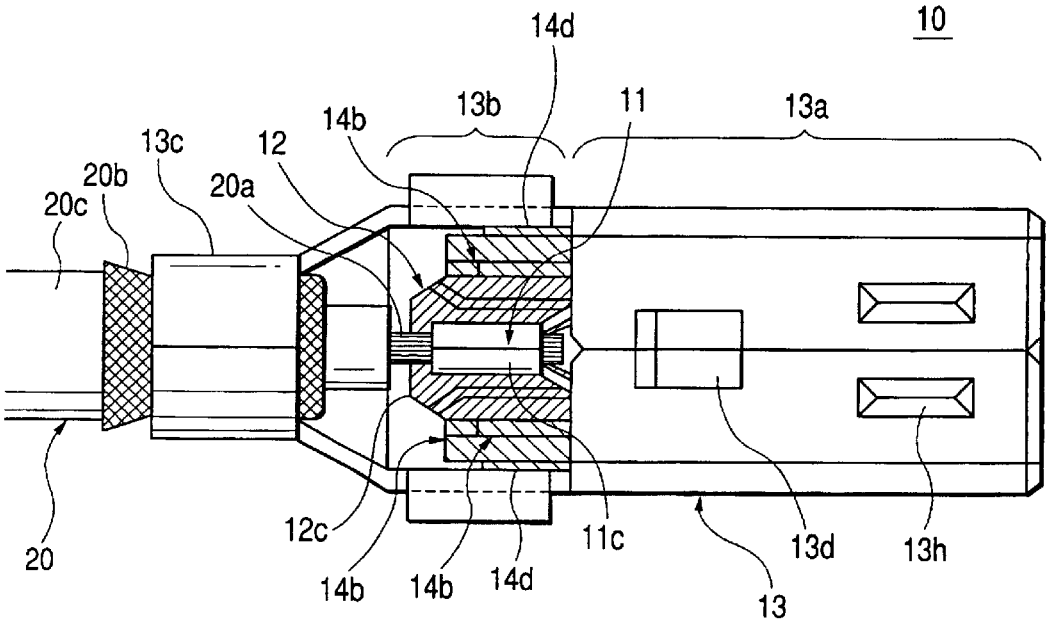
FIG. 2 is a top view showing the first shielding connector after it is assembled.

A shielding connector which is a preferred embodiment of the present invention will be described with reference to the accompanying drawings. FIG. 1 is an exploded perspective view showing a shielding connector 10; FIG. 2 is a top view showing the first shielding connector after it is assembled; FIG. 3 is a longitudinal sectional view and a cross sectional view showing a second shielding connector constructed according to the invention. As shown in FIG. 1, the shielding connector 10 is formed with a dielectric body 12 which will receive an inner conductor terminal 11, an outer conductor terminal 13 which will receive the dielectric body 12, and a small diameter member 14 to be mounted on the dielectric body 12. The inner conductor terminal 11 receives a high frequency signal transmitted thereto, and the outer conductor terminal 13 covers the inner conductor terminal 11 to magnetically shield the latter.

The inner conductor terminal 11 is formed by shaping a conductive plate member to be tapered off by bending process, and is coupled to the inner conductor terminal of a counter connector (not shown) for signal transmission/reception. The inner conductor terminal 11 is of the male terminal type, and includes a tab part 11*a*, shaped like a tab, which extends to the front from upright parts 11*b* standing upright from the right and left sides of the central part. When the tab part is fit to the inner conductor terminal of the counter connector, thereby setting up electrical connection between them. A press connection part 11*c* is provided at the rear side of the inner conductor terminal 11 The press connection part 11*c* includes press connection pieces 11*d* to be press connected to a signal conductor 20*a* of a shielded cable 20. The press connection pieces 11*d* are press connected to the signal conductor 20*a* and fixes the latter, whereby the inner conductor terminal 11 is brought into contact with the signal conductor 20*a* and electrically connected to the latter.

The dielectric body 12 which receives the inner conductor terminal 11 is formed with an insulating member having a predetermined dielectric constant. The dielectric body is assembled between the inner conductor terminal 11 and an outer conductor terminal 13 to thereby electrically insulate those terminals one from the other. A receiving part 12*a* for receiving the inner conductor terminal 11 is formed in a body part 12*b* opened at the front and rear thereof. A bottom part 12*c* extends rearward from the receiving part 12*a* of the body part 12*b*. The inner conductor terminal 11 is press fit into the dielectric body 12 from the rear side of the dielectric body 12, and fixed therein. At this time, the press connection part 11*c* of the inner conductor terminal 11 as fixed in the dielectric body is positioned on the bottom part 12*c* (see FIG. 2), and the right and left lower sides of the press connection part are covered with the outer wall of the bottom part 12*c*.

Figure 3A:
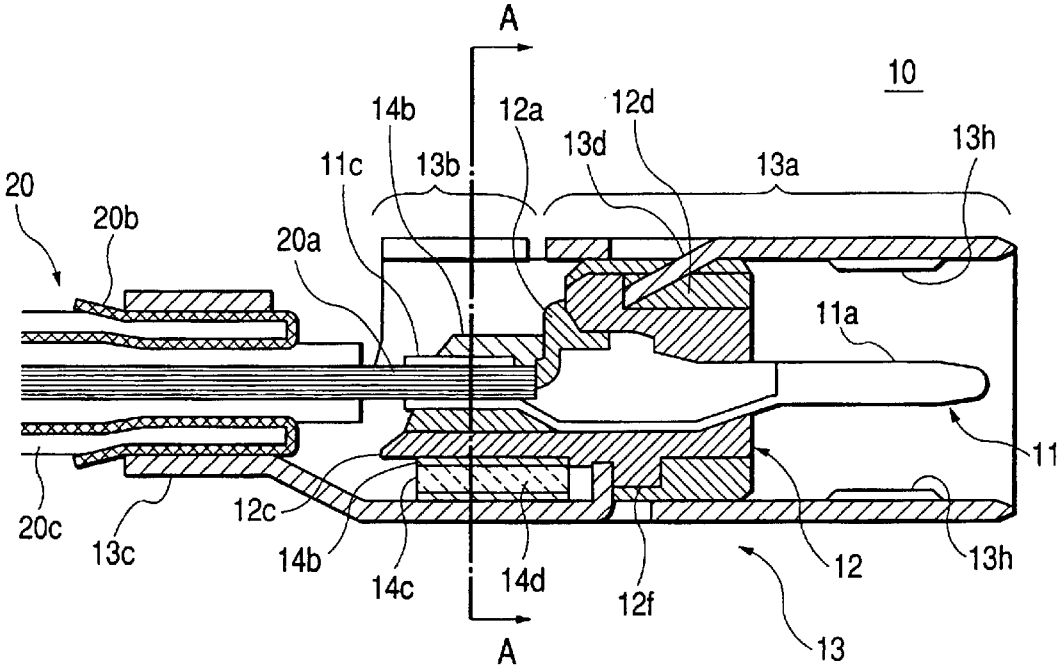
FIGS. 3A and 3B are a longitudinal sectional view and a cross sectional view showing a second shielding connector constructed according to the invention.

The outside diameter of the body part 12*b* of the dielectric body 12 is nearly equal to or somewhat smaller than the inside diameter of an outer conductor terminal 13 opened to the front, which will be described later. A recessed part 12*d* is formed in the upper surface of the body part 12*b*. When it is put in the outer conductor terminal 13, the recessed part engages with an assembling piece 13*d* similarly formed in the upper surface of a body part 13*a* of the outer conductor terminal 13. A protruded part 12*f* is formed in the bottom surface of the body part. The protruded part is stopped by a raised piece 13*e* raised innerwards from the bottom surface of the body part 13*a* of the outer conductor terminal 13 (FIG. 3A). The dielectric body 12 is put in the outer conductor terminal 13 immovably.

Groove parts 12*g*, each shaped like a groove, are formed on the right and left sides of the body part 12*b* of the dielectric body 12. The groove parts are used for coupling a small diameter member 14 to be described later to the dielectric body 12. When right and left engaging plates 14*a* of the small diameter member 14 are press fit into the groove parts, the end edges of the engaging plates 14*a* bite into the inner walls of the groove parts 12*g*, so that the former are not easily separated from the latter.

The outer conductor terminal 13 is formed to have a hollow by bending a conductive plate member by bending process. The outer conductor terminal is formed with a body part 13*a* opened to the front and rear, and a terminal insertion hole 13*b* opened to the upper and a cable press connection part 13*c* for fixing a cable.

The protruded part 12*f* maybe put within a receiving part 13*f* of the body part 13*a*. An elastic contact piece 13*g*, while being bent inward, is formed in each of the right and left side walls of the body part 13*a*. When the outer conductor terminal of the counter connector (not shown) is fit to those elastic contact pieces, those contact pieces come resilient contact with the outer wall of the outer conductor terminal 13. Contact pieces 13*h* are respectively provided on the upper and lower walls, and come in contact with the outer wall of the outer conductor terminal of the counter connector.

The terminal insertion hole 13*b* is configured such that it extends rearward from the body part 13*a*, and has an opening 13*i*. The terminal insertion hole is used when the upright parts 11*b* of the inner conductor terminal 11, which are press connected and fixed to the signal conductor 20*a* of the shielding connector 10, are hitched on the receiving part 12*a* of the dielectric body 12 fixedly put in the outer conductor terminal 13, and pushed to the inner part thereof by a suitable jig (not shown). In this case, a part of the press connection part 11*c* of the inner conductor terminal 11, which has been pushed into the receiving part 12*a* of the dielectric body 12 (see FIG. 2).

The cable press connection part 13*c* extends rearward from the terminal insertion hole 13*b*, and includes a pair of press connection parts 13*j* which press connect and fix the shielded cable 20 put on the cable press connection part 13*c*. In this case, an inverted part 20*d* is normally fixed, and hence press connected and fixed onto a sheath 20*c* as an outer covering of the shielded cable 20, whereby the outer conductor terminal 13 is in contact with the shielded conductor 20*b* and an electrical connection is set up therebetween.

An assembling piece 13*d*, which comes in engagement with the recessed part 12*d* of the dielectric body 12, is protruded innerwards at a rear part of the upper surface of the body part 13*a* of the outer conductor terminal 13. The raised piece 13*e* which comes into engagement with the protruded part 12*f* of the dielectric body 12, is provided at a rear part of the bottom surface thereof. Guide pieces 13*k* extend outward from the upper ends of the right and left side walls of the terminal insertion hole 13*b*. When the outer conductor terminal 13 is put in a connector housing (not shown), which is used for fixedly containing the outer conductor terminal 13 therein, the guide pieces are used for the outer conductor terminal to the guide grooves.

Now, the small diameter member 14 will be described. The small diameter member 14 is formed by bending a conductive plate member. A diameter of the small diameter member is smaller than that of the terminal insertion hole 13*b* of the outer conductor terminal 13, and includes small diameter parts 14*b*. The small diameter parts 14*b* surround the three sides of the press connection part 11*c* of the inner conductor terminal 11 which is located at the bottom part 12*c* of the dielectric body 12. Those parts 14*b* are coupled together by curved, cylindrical contact parts 14*c* (see FIG. 3B).

Contact protruded pieces 14*d* are formed in the outer walls of the right and left contact parts 14*c*. When the small diameter member 14 is put in the outer conductor terminal 13, it is brought into resilient contact with the inner wall of the terminal insertion hole 13*b* with the aid of the elasticity by the contact parts 14*c*, which is caused by its cylindrical formation, and the contact protruded pieces 14*d*. With the structure, the small diameter member 14 is electrically connected to the outer conductor terminal 13. In this case, the following construction is also allowed for the placement of the small diameter member. The width between the right and left contact parts 14*c* is somewhat larger than the outer conductor terminal 13, and the small diameter member is press inserted into the outer conductor terminal and fixedly placed therein.

The engaging plates 14*a* are extended forward from the right and left small diameter parts 14*b* of the small diameter member 14. And those are press fit into the right and left groove parts 12*g* of the dielectric body 12.

Figure 3B:
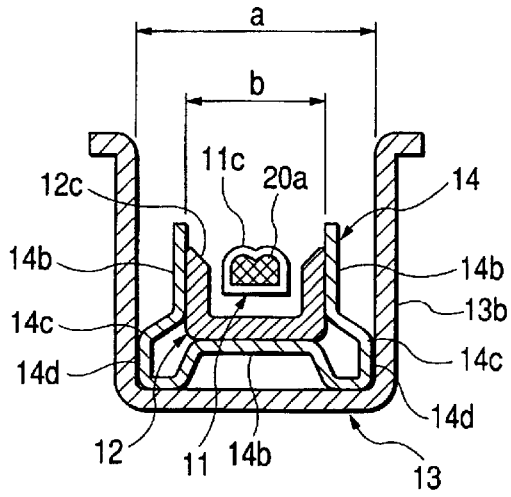
Figure 4A:
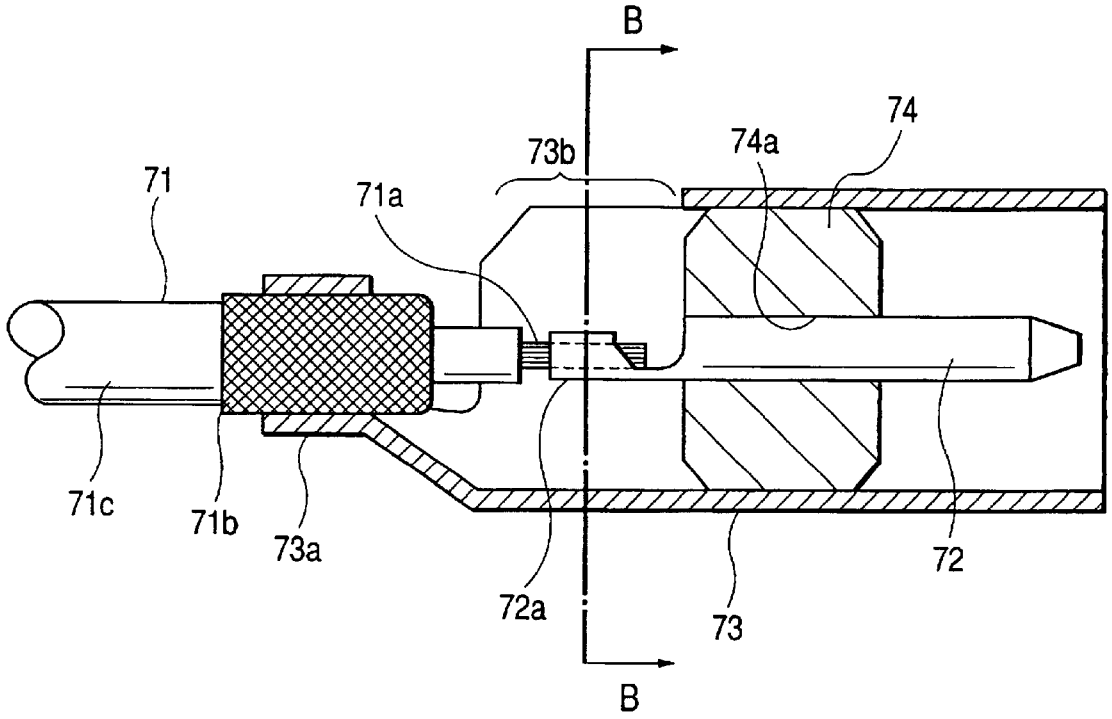
FIGS. 4A and 4B are a longitudinal sectional view and a cross sectional view showing a conventional shielding connector.
Figure 4B:
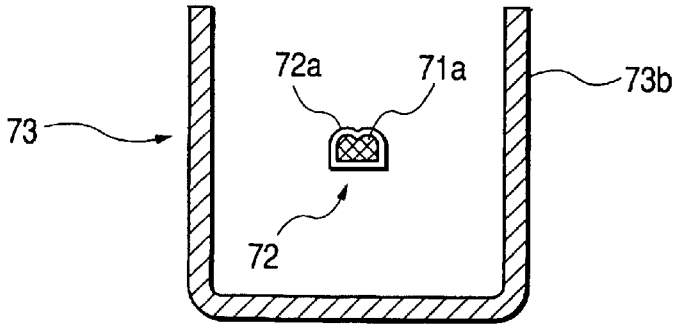
Figure 5A:
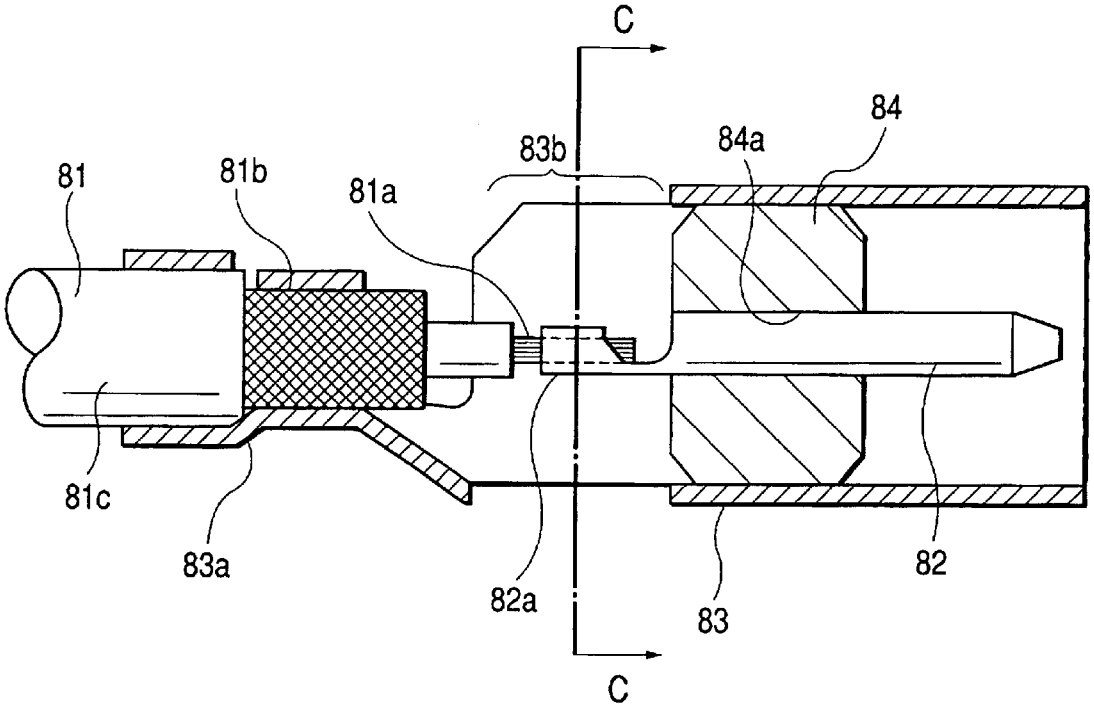
FIGS. 5A and 5B are a longitudinal sectional view and a cross sectional view showing another conventional shielding connector.
Figure 5B:
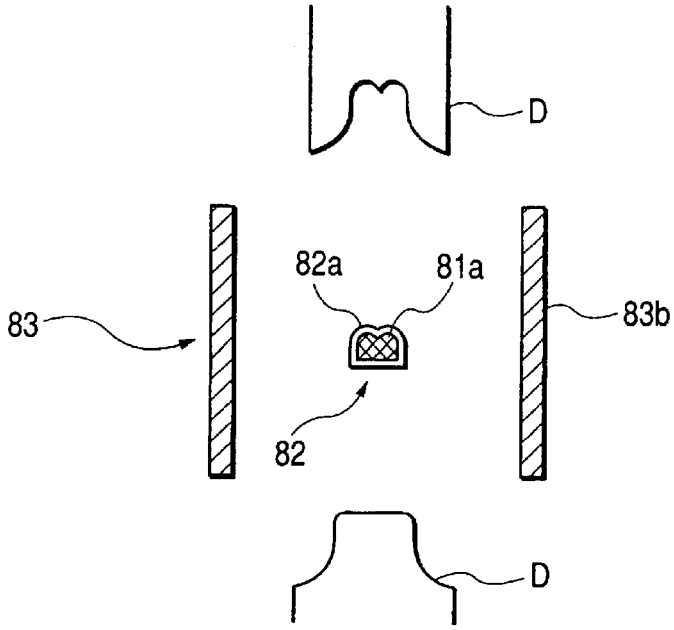

Function of the small diameter member 14 in the shielding connector 10 thus constructed will be described with reference to FIG. 3. FIG. 3A is a longitudinal sectional view showing the shielding connector of FIG. 2, and FIG. 3B is a cross sectional view taken on line A—A in FIG. 3A. As shown, usually, the press connection part 11*c* of the inner conductor terminal 11 illustrated is designed to have a size and a shape, while giving priority to a reliability of its electrical connection to the signal conductor 20*a* of the shielded cable 20. Generally, its diameter after it is press connected is smaller than that of the terminal portion. It is noted here that the three sides of the press connection part 11*c* of the inner conductor terminal 11, except the upper surface, after it is press connected, are surrounded by the small diameter parts 14*b* of the small diameter member 14, and the contact parts 14*c* comes in conductive contact with the outer conductor terminal. With this feature, the inside diameter of the outer conductor terminal 13 at that part is electrically reduced toward the press connection part 11*c*.

Thus, with provision of the small diameter member 14, the impedance in the vicinity of the press connection part 11*c*, which, in the conventional technique, is high since the press connection part is not covered by the outer conductor terminal and the dielectric body, can be set to be low. Therefore, if the impedance at this part in the connector is matched to that of the other portion, the impedance mismatching problem is solved, and the signal transmission loss by the signal reflection and the like is reduced. Further, as shown in FIG. 3B, an area of the terminal insertion hole 13*b* is reduced from an area "a" to an area "b", so that radiation noise and incident noise is reduced.

In the conventional connector structure, the impedance mismatching is inevitably present, and much noise is radiated from the part not covered with the outer conductor terminal. On the other hand, the shielding connector of the invention is well impedance matched at the corresponding part, and further the opening area is reduced toward outside. Accordingly, the shielding connector can handle electric signals at higher frequencies, and has good characteristics while being free from transmission efficiency reduction, noise generation resulting from signal reflection and other disadvantages.

The conventional shielding connector needs the process to manually increase the diameter of the press connection part by using the metal tape or the process to increase the same by pressing the metal sleeve. Instead of enlarging the press connection part, in the invention, the small diameter member 14 which electrically reduces the inside diameter of the outer conductor terminal at the corresponding part is merely placed in the outer conductor terminal 13. Accordingly, the terminal processing cost of the shielding connector of excellent high frequency characteristic is comparable with that of the conventional connector.

The terminal processing of connecting such a shielding connector to a shielded cable contains the following steps:

i) to remove the outer covering of a terminal of a shielded cable to expose a signal conductor and a shielding conductor;

ii) to press connect the inner conductor terminal to the signal conductor;

iii) to put the inner conductor terminal in an assembly which previously contains a small diameter member and a dielectric body;

iv) to press connect the outer conductor terminal to the shielding conductor.

Those steps of terminal processing are similar to those of the conventional one. If the small diameter member which is additionally used in the invention is assembled to the dielectric body and the outer conductor terminal in advance, the terminal processing to connect the shielding connector to the shielded cable can be substantially the same as the conventional one. There is no need of additionally installing the terminal processing machine every factory which actually carries out the cable terminal processing and every terminal processing line in such a factory. The shielding connector of the invention is extremely low in cost when comparing with the conventional shielding connector of comparable performances.

While the invention has been described using a specific embodiment, it should be understood that the invention is not limited to the embodiment described, but may variously be modified, altered and changed within the true spirits and scope of the invention. In the embodiment mentioned above, the small diameter member is assembled to the dielectric body in advance. If required, it may be assembled to the outer conductor terminal. In the embodiment, the small diameter member is an article formed by folding the conductive plate member (it may be fixed to the dielectric body by press fitting, resin molding or the like). The small diameter member may be formed in various methods. A first example of the small diameter member is formed by one-piece molding conductive resin material and dielectric material, viz., two-color molding them. A second example of it is formed in a manner that the dielectric body is plated with conductive material. While the shielding connector of the embodiment is of the male type, it is evident that the invention is applied to the shielding connector of the female type. Further, it should be understood that the invention is applied to the connection of aboard connector fixedly connected to the PC board to a cable connector connected to a cable, while the invention is applied to the connection of the cable connectors.

As seen from the foregoing description, in the shielding connector constructed according to the present invention, the impedance in the vicinity of the press connection part, which, in the conventional technique, is high since the press connection part is exposed outside through the opening of the outer conductor terminal, is successfully reduced by additionally using the small diameter member which electrically reduces the diameter of the opening of the outer conductor terminal at the corresponding part. Further, the construction for effecting such is simple, so that the connection of the connector to the cable is simple and accurate.

What is claimed is:

1. A shielding connector comprising:

a dielectric body;

an outer conductor terminal having a terminal insertion hole and an inner wall;

an inner conductor terminal to be connected to a signal conductor of a shielded cable, said inner conductor terminal being put in said outer conductor terminal containing said dielectric body, and a shielding conductor of said shielded cable connected to said outer conductor terminal, said shielding cable including said signal conductor, said shielding conductor and an insulating member interposed between said signal conductor and said shielding conductor, and said shielded cable being covered with a sheath, and a conductive small diameter member which electrically reduces a diameter of said terminal insertion hole toward a connection part provided in contact with the inner wall of said outer conductor terminal, wherein said terminal insertion hole is formed in said outer conductor terminal in order to put said inner conductor terminal in said outer conductor terminal in connection with said dielectric body, and said inner conductor terminal is put in said outer conductor terminal in a state that a press connection part at which said inner conductor terminal is connected to said signal conductor is exposed within said terminal insertion hole.

2. The shielding connector according to claim 1, wherein said small diameter member is installed to said dielectric body.

3. The shielding connector according to claim 1, wherein said small diameter member is formed by one-piece molding conductive material and dielectric material.

4. The shielding connector according to claim 1, wherein said small diameter member is press fitted into said outer conductor terminal.

5. The shielding connector according to claim 1, wherein said small diameter member is resiliently put in said outer conductor terminal.

6. The shielding connector according to claim 1, wherein said small diameter member electrically reduces said diameter at said terminal insertion hole around said exposed press connection part.

* * * * *